US011125444B2

(12) United States Patent
Graw et al.

(10) Patent No.: US 11,125,444 B2
(45) Date of Patent: Sep. 21, 2021

(54) VAPOR EXTRACTION DEVICE AND METHOD FOR CONTROLLING A VAPOR EXTRACTION DEVICE

(71) Applicant: BSH Bosch und Siemens Hausgeräte GmbH, Munich (DE)

(72) Inventors: Martin Graw, Königsbach-Stein (DE); Stefan Schrumpf, Bretten (DE); Markus Wössner, Zaberfeld (DE)

(73) Assignee: BSH Hausgeräte GmbH, Munich (DE)

( * ) Notice: Subject to any disclaimer, the term of this patent is extended or adjusted under 35 U.S.C. 154(b) by 1011 days.

(21) Appl. No.: 14/417,175

(22) PCT Filed: Jul. 18, 2013

(86) PCT No.: PCT/EP2013/065166
§ 371 (c)(1),
(2) Date: Jan. 26, 2015

(87) PCT Pub. No.: WO2014/019862
PCT Pub. Date: Feb. 6, 2014

(65) Prior Publication Data

US 2015/0192305 A1 Jul. 9, 2015

(30) Foreign Application Priority Data

Aug. 2, 2012 (DE) ..... 10 2012 213 692.4

(51) Int. Cl.
*F24C 15/20* (2006.01)
*B08B 15/02* (2006.01)

(52) U.S. Cl.
CPC ..... *F24C 15/2021* (2013.01); *F24C 15/2042* (2013.01); *B08B 15/02* (2013.01)

(58) Field of Classification Search
CPC ..... F24C 15/2021; F24C 15/2042
See application file for complete search history.

(56) References Cited

U.S. PATENT DOCUMENTS 5,015,812 A * 5/1991 Kasai ..... H05B 6/6411 219/400
5,793,645 A * 8/1998 Rump ..... B60H 1/008 422/94

(Continued)

FOREIGN PATENT DOCUMENTS

CN 1688872 A 10/2005
DE 4407969 A1 9/1994

(Continued)

OTHER PUBLICATIONS

National Search Report CN 201380040959.1 dated May 9, 2017.

(Continued)

*Primary Examiner* — Avinash A Savani
*Assistant Examiner* — Deepak A Deean
(74) *Attorney, Agent, or Firm* — Michael E. Tschupp; Andre Pallapies; Brandon G. Braun

(57) ABSTRACT

A vapor extraction device includes a fan box, a fan having a fan motor accommodated in the fan box, and a first sensor arranged in or on the fan box and configured to determine a first odor status of a cooking environment of the vapor extraction device. The fan motor of the fan can be controlled by performing a cooking process detection, performing an odor pollution determination in response to the cooking process detection, and controlling the fan motor to a fan level in response to the odor pollution determination.

18 Claims, 5 Drawing Sheets

(56) References Cited

U.S. PATENT DOCUMENTS

| | | | | |
|---|---|---|---|---|
| 6,142,142 | A * | 11/2000 | Woodall, III | F04D 27/004 126/299 R |
| 6,170,480 | B1 * | 1/2001 | Melink | F24C 15/2021 126/299 D |
| 6,446,624 | B1 | 9/2002 | Chu | |
| 6,920,874 | B1 * | 7/2005 | Siegel | F24C 15/2021 126/21 A |
| 7,048,199 | B2 * | 5/2006 | Melink | F24C 15/2021 126/299 D |
| 7,699,051 | B2 * | 4/2010 | Gagas | F24C 15/2028 126/299 D |
| 8,155,912 | B2 | 4/2012 | Souilmi | |
| 8,312,873 | B2 * | 11/2012 | Gagas | F24C 15/2035 126/299 D |
| 8,487,776 | B2 * | 7/2013 | Livchak | F23J 3/026 340/540 |
| 8,511,578 | B2 * | 8/2013 | Has | F24C 15/2021 126/299 R |
| 9,677,772 | B2 * | 6/2017 | Siegel | F24C 15/2021 |
| 2005/0150387 | A1 * | 7/2005 | Has | F24C 15/2021 96/407 |
| 2005/0224069 | A1 * | 10/2005 | Patil | F24C 15/2021 126/299 D |
| 2007/0105494 | A1 | 5/2007 | Lin | |
| 2008/0274683 | A1 * | 11/2008 | Burdett | F24C 15/2021 454/61 |
| 2010/0297928 | A1 * | 11/2010 | So | F24C 15/2021 454/341 |
| 2012/0122386 | A1 * | 5/2012 | Uebele | F24C 15/2021 454/67 |
| 2012/0125206 | A1 * | 5/2012 | Yamane | F24C 15/2007 99/337 |
| 2014/0230662 | A1 * | 8/2014 | Siegel | F24C 15/2021 99/344 |
| 2015/0136430 | A1 * | 5/2015 | Livchak | F24C 15/2021 169/46 |

FOREIGN PATENT DOCUMENTS

| | | | |
|---|---|---|---|
| DE | 10232992 | A1 | 1/2004 |
| DE | 102004039549 | A1 | 11/2005 |
| DE | 102005025787 | B3 | 1/2007 |
| DE | 102011082926 | A1 | 3/2013 |
| EP | 1452804 | A1 | 9/2004 |
| EP | 2261569 | A1 | 12/2010 |
| JP | 2008128579 | A | 6/2008 |
| WO | 03098116 | A1 | 11/2003 |

OTHER PUBLICATIONS

International Search Report PCT/EP2013/065166 dated Jan. 31, 213.

National Search Report DE 10 2012 213 692.4 dated Apr. 22, 2013.

* cited by examiner

VAPOR EXTRACTION DEVICE AND METHOD FOR CONTROLLING A VAPOR EXTRACTION DEVICE

BACKGROUND OF THE INVENTION

The invention relates to a vapor extraction device and a method for controlling a fan motor of a fan as well as a method for determining air cleaning effect.

With known ventilation concepts steam and/or vapor is detected by means of a sensor located outside the vapor extraction device but in its visible range. Additionally or alternatively the speed of the fan for extracting the steam and/or vapor is set by means of fan stages of the fan motor of the fan of the vapor extraction device available in/on the vapor extraction device. The sensors used here are generally gas sensors, moisture sensors, temperature sensors and/or ultrasound sensors.

The fan of the vapor extraction device is generally controlled to different fan stages in that every fan stage is usually assigned a predetermined fixed threshold value for the sensor information so that when the sensor information is below or above this threshold value, the fan switches to the next lowest or next highest fan stage.

This can result increasingly in sudden switching of the fan stages of the fan motor of the fan of the vapor extraction device. Also when the vapor extraction device is operating at higher air delivery rates, turbulent flows increasingly occur, making the use of an ultrasound sensor for example problematic.

BRIEF SUMMARY OF THE INVENTION

The object of the invention is therefore to provide a vapor extraction device and a method which avoid at least some of the abovementioned disadvantages and/or limitations with the presence of a sensor for determining odor.

The invention is based on providing a vapor extraction device for extracting odors and/or vapor in a cooking environment by the suitable arrangement of a sensor for determining odor and appropriate evaluation of the sensor information, providing a fan response of the vapor extraction device more precisely optimized for the odors and/or vapor actually present.

The invention achieves the object by supplying a device for detecting and extracting odors and/or vapor in a cooking environment, and two methods. The first method allows the determination of a conclusion relating to the air cleaning effect of the vapor extraction device. The second method allows the regulated control of a fan motor of a fan of the vapor extraction device to a fan level. In one advantageous embodiment the second method integrates the conclusion relating to the air cleaning effect to control the fan of the first method with optimized regulation.

According to a first aspect of the invention a device inventively has a fan with a fan motor, a fan box and a first sensor. The device is characterized in that the first sensor is arranged in or on the fan box, with a first odor status of a cooking environment of the vapor extraction device being determined by means of the first sensor.

BRIEF DESCRIPTION OF THE DRAWINGS

According to the invention a vapor extraction device is a suction device for extracting ambient air around a cooker, such air generally being polluted with vapor and/or odors. In particular a domestic suction device, in particular for the kitchen, is referred to as a vapor extraction device. The vapor extraction devices also referred to as extractor hoods or vapor extractors are used in particular above a cooker, as cooking produces odors and vapor which not only pollute the air with fats and oils for example but also impair visibility and condense on objects in the kitchen.

Within the meaning of the present invention a fan box refers to a housing, in which at least part of the fan, in particular at least the motor of the fan of the vapor extraction device, is accommodated. The fan itself can also be accommodated in its entirety in the fan box. The fan box is also referred to as the fan housing in the following.

Figure 1:
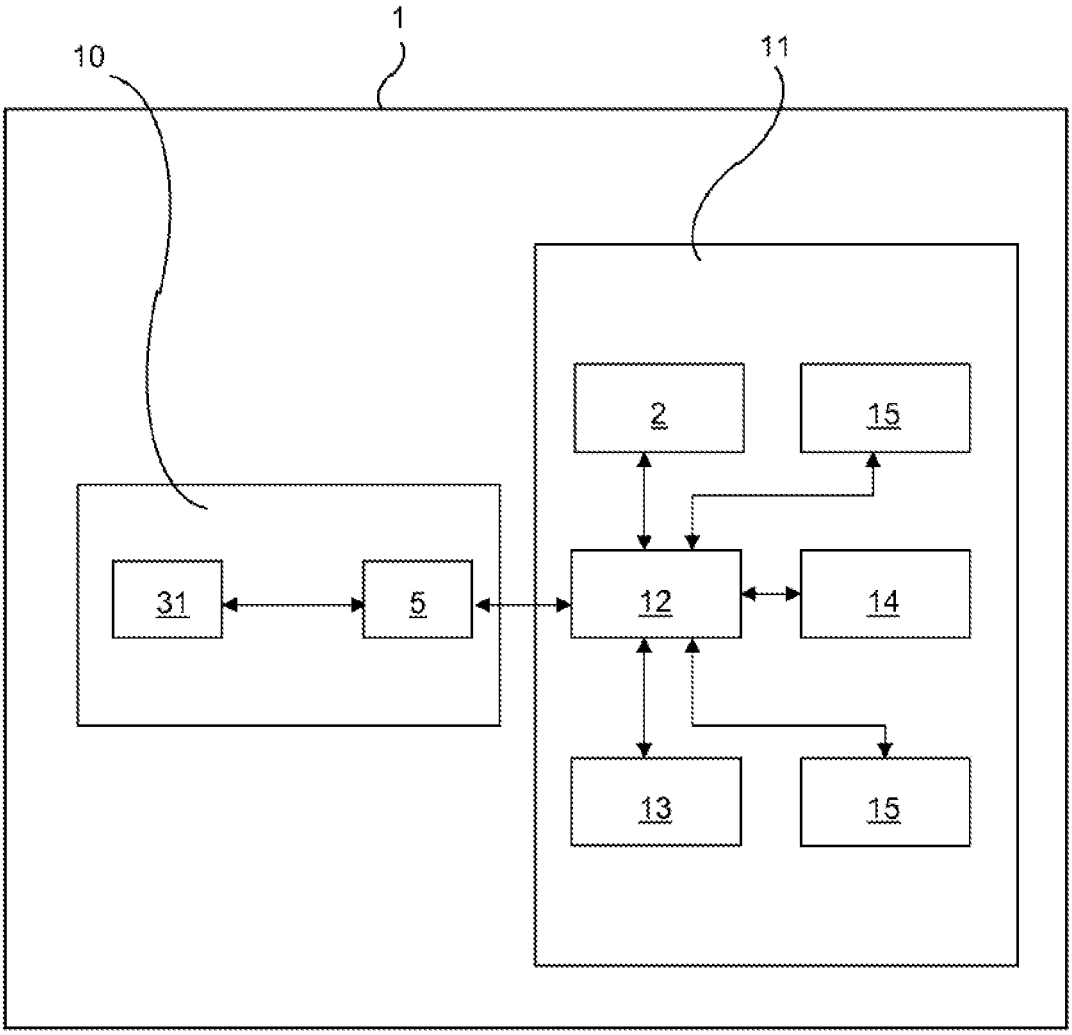

According to the invention a sensor is a device for detecting odors and/or vapor, as produced during cooking in a kitchen. The sensor can therefore also be referred to as an odor sensor. The sensor can supply the detected information, also referred to in the following as sensor information, for example in the form of an electrical signal, a pressure, an electrical resistance and the like. According to the invention a gas sensor is preferably used and its resistance is used to determine the odor status.

Within the meaning of the invention the odor status of a cooking environment refers to the odor condition of the air currently present. The odor status can therefore also be referred to as an absolute odor level of the cooking environment. This odor status can be determined by sensor information that indicates the currently prevailing odor conditions of the cooking environment. The sensor information used to determine the odor status is preferably captured over time. This means that the sensor captures values at temporally predetermined intervals or continuously and outputs information that indicates the currently prevailing odor conditions of the cooking environment. As well as the sensor information or the odor status determined therefrom, the time at which the sensor information was captured is also preferably recorded and in particular stored. The odor conditions result for example during cooking in a kitchen or are influenced by further ambient conditions, for example open windows and the like.

Within the meaning of the invention the cooking environment, the odor status of which is determined, comprises both the cooking climate, in other words the long-term odor conditions in the room in which the vapor extraction device is operated, and optionally also in the vapor extraction device, as well as a cooking process, in other words the odor conditions that change quickly or suddenly and generally in an extreme manner in the room and optionally in the vapor extraction device.

Within the meaning of the present invention determining the first odor status by means of the first sensor means capturing sensor information, such as for example a resistance value of the sensor, which can inform about the odor status. In particular the sensor information can be further processed for the purpose of determining the first odor status. Within the meaning of the present invention the odor status therefore preferably represents a dimensionless variable calculated from the captured sensor information. The variable thus determined can also be smoothed for example by using a low-pass filter. Unless otherwise stated therefore the dimensionless variable converted and smoothed from the captured sensor information of an odor sensor is preferably referred to in the following as the odor status.

According to the invention the sensor is arranged in or on the fan box. The sensor is arranged in such a manner here that it is located in the air flow generated by the fan preferably provided in the fan box. The sensor here can be provided in or on the air inlet of the fan box and/or in or on the air outlet of the fan box. Within the meaning of the invention the sensor is preferably arranged in the interior of the vapor extraction device in such a manner that the sensor is arranged in the air flow leaving the fan regardless of the number of intake openings in the vapor extraction device.

This arrangement of the first sensor in the interior of the vapor extraction device has the advantage that the sensor in particular detects the odor taken in regardless of where the odor and/or vapor is emitted outside the vapor extraction device. In the case of sensors arranged at the intake opening of the vapor extraction device it may however happen that odors from a source removed from the site of the sensor, for example a cooking zone of a cooktop further away, are not captured. This is not a concern with the inventive sensor arrangement and a representative odor status of the cooking environment, which provides information about the conditions actually prevailing in the environment of the vapor extraction device, can be reliably captured. The arrangement of the first sensor in the interior of the vapor extraction device, in particular on or in the fan box, has the further advantage that it is not visible to the user of the vapor extraction device. This arrangement is also advantageous as air, which reaches the fan box, has generally already had fat and other contaminants, such as moisture particles, removed. Soiling of the sensor can therefore be reliably avoided with the inventive arrangement.

According to one embodiment the vapor extraction device has a control device, which preferably is or comprises a microcontroller, and the control device is designed to determine and/or supply a flexible reference value for processing with the determined first odor status.

A control device within the meaning of the invention is a device that serves to control a fan motor of the fan of the vapor extraction device electrically or mechanically. According to the invention this control device also serves to determine and/or supply a reference value.

Determination of a reference value here preferably means the calculation of a reference value from at least one measured variable, in particular from sensor signals. Supplying a reference value preferably means reading a reference value out from previously calculated values, for example from a reference value table.

The control device can comprise a sensor for example or can be connected to a sensor, which can be different from the first sensor. However it is also possible and preferable for the control device to be connected to the first sensor in such a manner that sensor information serves to determine the reference value is obtained from this sensor.

In one embodiment the control device can also comprise for example a mechanical and/or electrical circuit. This circuit can serve not only to determine and/or supply the flexible reference value but also to control the fan of the vapor extraction device. The control device according to the present invention is preferably a processing unit, preferably a microcontroller (μC), or comprises such a processing unit.

A reference value within the meaning of the invention is a value that can be used to control the fan of a vapor extraction device or by means of which conclusions can be drawn relating to the state of the vapor extraction device and in particular the air cleaning effect of the vapor extraction device and in particular of filter elements, in particular odor filters, in the vapor extraction device. In contrast to the prior art the reference value here is not a permanently predetermined value which is compared with captured sensor information.

According to the present invention a flexible reference value refers to a reference value which is a function of changing variables, in particular sensor information, and/or is determined from these. A time factor can also be taken into account with a flexible reference value. The flexible reference value can also be referred to as a variable reference value. Unless otherwise stated, the term reference value in the following refers to a flexible reference value within the meaning of the invention.

In the simplest instance the flexible reference value can be a threshold value, which is determined directly from captured sensor information or from values formed therefrom, in particular the determined odor status.

The reference value can be captured or determined by the control device. It is also possible for the reference value to be saved or stored in the control device from previous cooking processes. The reference value can be stored in a threshold value table in particular in this instance. If the reference value is determined by the control device, it can also be determined from a threshold value function over time or the like.

The reference value can also be used in a calculation instead of a threshold value in which only the fact of being greater or less than is monitored. This calculation can be used for example to determine the fan level of the fan motor of the fan of the vapor extraction device. In this instance the reference value is preferably processed with the determined odor status according to the invention. In this instance the reference value can represent for example an odor level, which is explained below and which is deducted from the determined odor status. When determining an air cleaning effect the reference value can be for example a value of an odor status captured by a different sensor and this can also be used to form a difference in relation to the first odor status and thus be processed with this.

According to the invention a single reference value can be used, which then preferably represents a threshold value. According to the invention however at least a second reference value can also be supplied. The second reference value can be used for example when controlling the fan level of the fan. The second reference value is preferably not always identical to the first reference value so that there are two different reference values in order to be able to detect an active cooking process in the cooking environment even more precisely.

With the embodiment with which a flexible or variable reference value is determined and/or supplied by the control device and processed with the determined first odor status it is possible to assess or take into account the current ambient conditions of the vapor extraction device in an accurate manner. In contrast to the prior art, in which a fixed threshold value is used, the results of processing the determined odor status are obtained according to current conditions and are therefore more reliable. With the present invention the result of processing the odor status with the variable reference value is also advantageous as the odor status can also be determined more reliably due to the arrangement of the sensor in the interior of the vapor extraction device.

According to one preferred embodiment the vapor extraction device comprises at least one cooking process detection unit and at least one odor pollution determination unit. The at least one cooking process detection unit and the at least one odor pollution determination unit are preferably provided in a control device. The first sensor in the vapor extraction device is at least connected to the odor pollution determination unit to convey and/or supply sensor information.

Within the meaning of the present invention a cooking process detection unit refers to a unit which is used to detect whether a cooking process is currently taking place, in other words is being performed. Within the meaning of the invention cooking process detection therefore refers to a process logic, the arithmetic of which determines whether or not a cooking process has been detected. Cooking process detection here may require one or even more input parameters. These can also be weighted differently.

The odor pollution determination unit refers to a unit which can be used to determine current, relative odor pollution of the cooking environment of the vapor extraction device or of the vapor extraction device.

The cooking process detection unit and the odor pollution determination unit can also be provided together and are preferably configured in particular as circuits and/or software. Said units are preferably provided in a control device, which is preferably a microcontroller or comprises a microcontroller, or are connected thereto. The control device preferably corresponds to the abovementioned control device which serves to determine and/or supply the reference value.

Because a cooking process detection unit is provided separately from the odor pollution determination unit according to the invention it is possible not only just to detect a cooking process but also to determine the currently prevailing ambient conditions, thereby improving the result of processing in particular the odor status with a reference value. Because the first sensor is also connected to the odor pollution determination unit for conveying sensor information, it is possible to determine odor pollution in the odor pollution determination unit using the sensor information. With the present invention the detection of a cooking process can be used on the one hand to initiate control of the fan motor of the fan of the vapor extraction device. However the detection of the cooking process is also preferably used in order to be able to calculate the values to be taken into account for control, in particular the current relative odor pollution, more accurately.

According to one preferred embodiment therefore the output of the cooking process detection unit is connected to the odor pollution determination unit and the output of the odor pollution determination unit, in particular of the control device, is connected to an electronic control system for controlling the fan motor.

By connecting the output of the cooking process detection unit to the odor pollution determination unit it is possible to supply the result of the cooking process detection unit to the odor pollution determination unit so that it can be taken into account when calculating the current relative odor pollution. As the output of the odor pollution determination unit is connected to the electronic control system for controlling the fan motor, a fan level of the fan can be set by this means as a function of the current relative odor pollution, thereby on the one hand preventing unnecessary switching to a higher fan level, also referred to as a fan stage, or allowing timely switching to a lower fan level. As a relative odor pollution can be determined during odor pollution determination, it is possible for example to take into account circumstances which influence the climate of the cooking environment, referred to in the following as the cooking climate. Such circumstances are for example a generally higher odor status in the room in which the vapor extraction device is operated, which is the result for example of pollution such as cigarette smoke or other odor sources.

In one advantageous embodiment of the invention provision is therefore made for the vapor extraction device to have a control device. The control device is designed to determine and/or supply at least one flexible reference value and the first odor status and at least one of the reference values is used to control a fan level of the fan motor. The use of the odor status and a flexible reference value here preferably represents a processing, in particular a comparison.

The control device is preferably the control device in which or on which the cooking process detection unit and the odor pollution determination unit are provided.

The fan level of the fan motor of the fan of the vapor extraction device, which can also be referred to as the fan speed, according to the invention is the intake force generated by way of the fan. It can be varied for example by the rotation speed of the blades of a fan. According to the invention the fan level can be referred to in stages, which are also referred to as fan stages and are predetermined in the vapor extraction device. However the fan level can preferably be set infinitely.

The embodiment with which a control device for determining and/or supplying a flexible reference value is provided in addition to the first sensor has the advantage that the fan level of the fan of a vapor extraction device can be set in a flexible manner. In particular the fan level can be set as a function of the reference value and the odor status.

In one advantageous embodiment of the invention provision is made for the first sensor to be assisted by a microcontroller, the microcontroller determining and/or supplying the flexible reference value. Assistance of the sensor by a microcontroller within the meaning of the invention means in particular the provision of an electrical circuit or software to allow sensor information captured by at least the first sensor to be stored and/or evaluated over time. According to the invention therefore flexible control of the fan level of the fan is possible. As well as allowing the calculation of a reference value, in particular a threshold value, the use of a microcontroller also allows a threshold value table to be supplied or a threshold value function to be determined for the reference value. It is also possible for the microcontroller to take over control of the fan. This also allows more complex evaluation of the sensor signal, allowing the fan to be controlled in an optimized manner and/or more precisely as a function of the odor status. The sensor and microcontroller are preferably positioned together on a circuit board, thereby reducing production costs when manufacturing the vapor extraction device.

By integrating the sensor, which is provided on or in the fan box according to the invention, together with the microcontroller on a circuit board it is also possible to keep the electrical path from the microcontroller to the fan short.

The control device preferably determines a first odor level with the aid of the first odor status. The odor level here can be determined in the cooking process detection unit or the odor pollution determination unit or in a unit provided separately therefrom. The control device performs the cooking process detection with the aid of the first odor level and a reference value, which represents a threshold value.

In contrast to the odor status the odor level within the meaning of the invention does not refer to the capturing of odors of a cooking environment over time but to the evaluation of said captured values, in particular sensor information, over time. In particular the odor level represents a filter result of the filtering of an odor filter status generated from sensor information, which is a dimensional variable and is preferably smoothed. Determining the odor level produces a mean permanent variable which preferably only changes constantly over time. The odor level can therefore also be referred to as a sliding mean value of the air quality of the cooking environment. This air quality parameter is preferably determined and stored in the control device, in particular in a microcontroller.

Because an odor level is formed and used for cooking process detection, a cooking process can be determined more reliably than by using the current odor status directly.

The first odor level is preferably characterized by fast changing states of the odor status. In one advantageous embodiment of the invention provision is also made for the reference value, which represents a threshold value, to be determined in a variable manner as a function of the odor status.

Because the reference value is designed to be variable, said reference value can be considered to be more reliable in respect of detecting whether a cooking process is active, as said reference value can therefore be tailored to the cooking environment or takes into account the current cooking environment.

If the reference value is dependent on the odor status and therefore represents a function of the odor status, the reference value is a flexible value which is better tailored to the current cooking environment and can therefore function for example as a more precise threshold value for the cooking process determination.

Additionally or alternatively the reference value can also be a function of a time constant. This dependency allows the reference value to be designed for example to take more account of shorter term or longer term odor status changes.

Because the cooking process determination is performed with the aid of the first odor level and a flexible reference value, which represents a threshold value, the result of the cooking process determination can be made for example a function of whether the result is above or below the reference value. The result of the cooking process determination is preferably stored in the control device. This allows even more precise detection of a cooking process in the cooking environment.

In one advantageous embodiment of the invention provision is made for it to be possible for the control device, in particular a microcontroller to control, preferably regulate, the fan motor of the fan of the vapor extraction device in order to set the fan level.

Because the fan can be controlled by the control device, the overall logic system, which performs the evaluation of the first odor status, detects the cooking process and controls the fan accordingly, can be integrated together in the control device. This reduces production costs still further. As the control device can control the fan motor of the fan, it is therefore possible to respond to the current cooking situation in the cooking environment. The fan level of the fan can thus be controlled in a varied manner as a function of the determined value relating to whether a cooking process is active.

By controlling the fan in a regulatable manner it is possible to set the fan level even more precisely for the current cooking situation in the cooking environment.

In one advantageous embodiment of the invention provision is made for it to be possible for the fan level of the fan motor of the fan to be set infinitely. Conventional fans of vapor extraction devices generally have around three to four fan levels, also referred to as fan stages. Within the meaning of the invention an infinitely settable fan level of a fan motor of the fan of a vapor extraction device is a fan with many more than three fan levels. Such a fan preferably has so many fan levels that it can be referred to infinite. In particular the fan level of such a fan can be increased or lowered continuously.

It is therefore possible for the fan level to be regulated in such a manner that it can be set optimally for the need for extraction from the cooking environment.

In one advantageous embodiment of the invention provision is made for the vapor extraction device to have a second sensor in addition to the first sensor. The second sensor here is preferably arranged outside the vapor extraction device in direct proximity thereto. The second sensor is used to determine a second odor status of the cooking environment of the vapor extraction device. The two sensors are connected to a processing unit for determining the air cleaning effect of the vapor extraction device. The air cleaning effect is preferably determined by means of the first odor status and the second odor status. The air cleaning effect can be determined over time.

If for example an active carbon filter is used as the odor filter in the vapor extraction device, with this embodiment of the invention a conclusion can be drawn relating to the air cleaning effect of the active carbon for example based on the differential signals of the two sensor systems. It is also possible to draw a conclusion relating to the degree of saturation of the active carbon with this embodiment of the invention.

This has the advantage that it can be signaled to the user of the vapor extraction device for example when the active carbon filter is to be replaced. A non-optimum mode of operation of the fan or of the air cleaning effect can also be signaled to the user so that maintenance of the vapor extraction device for example can be initiated.

Definitions and features described with reference to the vapor extraction device also apply—where applicable—to the inventive method(s) and vice versa and are therefore only described once.

According to a further aspect the invention relates to a method for performing an air cleaning effect determination for an inventive vapor extraction device. The method includes at least the following steps:

determining a first odor status of a cooking environment of the vapor extraction device, determining a second odor status of a cooking environment of the vapor extraction device, performing an air cleaning effect determination by means of a suitable combination of the two determined odor statuses, in particular by means of a suitable differentiation between the two odor statuses.

The air cleaning effect determination is preferably performed over time. According to the invention the second odor status is preferably determined independently of the first odor status. This can be done for example by capturing the first odor status using a sensor integrated internally in the vapor extraction device. The second odor status can then be captured for example using a sensor arranged on or in proximity to the vapor extraction device. It is also possible to use different types of sensor.

By comparing the two determined odor statuses, in particular over time, it is possible to draw a conclusion relating to the air cleaning effect of a filter, for example an odor filter. It is also therefore possible to determine the saturation content of the odor filter, for example of an active carbon filter. This allows it to be signaled to the user of the vapor extraction device how full the filter is and whether replacement is recommended.

It may therefore also be possible to determine whether a fault may be present, for example if the odor filter, in particular the active carbon filter, is not inserted correctly and the air cleaning effect is therefore significantly reduced.

According to a further aspect the invention relates to a method for controlling a fan motor of a fan of an inventive vapor extraction device. According to the invention the method includes at least the following steps:

performing a cooking process detection, performing an odor pollution determination with the aid of the result of the cooking process detection, and controlling the fan motor of the vapor extraction device to a fan level with the aid of the result of the odor pollution determination.

As already described with reference to the inventive vapor extraction device, it is advantageous to perform a cooking process detection separately from an odor pollution determination. This allows the current odor conditions for example to be taken into account and different criteria to be used for the cooking process detection and the odor pollution determination. As the odor pollution determination also takes place with the aid of the cooking process detection, a cooking process that is not being performed or is no longer being performed for example can be treated differently during the odor pollution determination from a cooking process currently being performed. In particular odor pollution determinations can be subject to different criteria.

According to one embodiment the controlling method is characterized in that a first odor status of a cooking environment of the vapor extraction device is determined;

a first odor level is determined from the first odor status;

a first reference value, which represents a threshold value, is determined and/or supplied; and the cooking process determination is performed with the aid of the odor level and at least the first reference value.

The first odor level here can be determined by means of characteristics corresponding to a cooking process. In particular the first odor level represents the evaluation of values captured using at least one sensor, in particular sensor information, over time. The first odor level here serves to detect a cooking process. The threshold value is preferably a function of the odor status. Because the first odor level, which can provide information relating to the cooking process, is used instead of the first odor status, the cooking process detection can be performed more accurately. This is particularly because the odor level represents a mean air quality value.

In one advantageous embodiment of the invention provision is made with the controlling method for at least one, preferably at least two, reference values to be used, which represent threshold values and are preferably a function of the determined odor status of the cooking environment and/or of a time constant. The reference values used here are preferably threshold values, which are particularly suitable for the comparison of an odor level determined from the odor status.

A second reference value used in addition to the first reference value preferably represents a threshold value, which can be compared with the result of the odor pollution determination. The second reference value is also preferably a function of the first odor status of the cooking environment. The second reference value preferably has a time constant that is different from the first reference value.

A result of the odor pollution determination is preferably used during the cooking process detection.

The result of the odor pollution determination can also be used in the cooking process detection, in the same way as the second or further reference value. This allows an even better reference value basis to be generated, in order to be able to detect an active cooking process in the cooking environment even more precisely. Because an already determined odor pollution is used in the cooking process detection it is in particular possible to determine more accurately whether or not a cooking process is still active.

In a further embodiment of the invention provision is made for at least a second odor level, preferably a second odor level and a third odor level, to be determined from the first odor status and for the second and/or third odor level to be used for the odor pollution determination, in particular to determine the current relative odor pollution of the cooking environment. According to the invention the current, relative odor pollution is referred to as the result of the odor pollution determination and preferably represents the difference between the first odor status and a second and/or third odor level.

The second odor level here can be determined by means of characteristics corresponding to the climate of the cooking environment. In particular slow, constantly changing states of the odor status are referred to as characteristics of the climate here. The second odor level is therefore also referred to as the odor level of the cooking climate. It is generally different from the odor level of a cooking process that was/is referred to as the first odor level. The odor level of the cooking climate can be influenced for example by the air in the cooking environment, the number of people present in the cooking environment or even by an open or closed window.

It is therefore possible to determine the odor pollution as a function of the odor level of the cooking climate and the detection of a cooking process and to set the fan level of the fan as a function of this odor pollution.

The second odor level can be determined with the additional aid of the result of the cooking process detection. In particular the second odor level determination can be restricted to only being performed if no cooking process is detected.

This advantageous embodiment allows the fan of the vapor extraction device to be coordinated better with the external conditions in the cooking environment, so that the air volume delivery rate can be better tailored to the actual cooking process.

Including the odor status in the odor pollution determination allows the latter to be performed more precisely.

The third odor level can differ in the manner of its determination from that of the second odor level. It is possible for example to use different time constants to distinguish for example between a short-term odor level and a longer-term odor level of the cooking climate when determining the two odor levels. It is therefore possible to determine the odor pollution of the cooking environment in a more differentiated manner.

If a cooking process is active and odor pollution due to the cooking process is therefore determined, it is possible for example to stop the determination of the second odor level. This can prevent the second odor level being influenced by the odor pollution of the cooking process.

According to one preferred embodiment the odor level is determined from the odor status separately by detecting fast changes and slow changes in the odor status. A fast change here indicates a cooking process and a slower change provides information relating to the current conditions of the cooking climate of the cooking environment. The odor level is preferably determined using filters, in particular a high-pass filter and one or more low-pass filters. The outputs of the respective filters therefore represent the respective odor levels.

Different odor levels are preferably determined when determining the odor level as a function of time. This can be done by using different filters, in particular different filter outputs, at different times. The filters here can calculate the odor levels for example over different times. This allows results that indicate the faster or slower changing of the cooking climate to be used separately, so that they can be used separately in the evaluation, in particular to control the fan motor.

According to one preferred embodiment the cooking process detection comprises a detection control, by means of which the result of an initial cooking process detection is checked.

Generally only one condition is checked here as the initial cooking process detection. In particular for example the exceeding of a threshold value by the first odor level and/or the exceeding of a threshold value by the current, relative odor pollution is checked.

During the detection control however a number of conditions are preferably checked at the same time. A reference value, in particular a threshold value, can also be used here, results below which are checked for a predetermined time.

A third reference value, which represents a threshold value, can also serve for example to prevent a cooking process that has once been determined remaining as determined even though it has already been completed. If the result of the cooking process determination is above or below the third reference value, it can indicate that no cooking process is active, even if other reference values and/or input parameters relating to the cooking process determination indicate the opposite result.

This has the advantage that a cooking process determination can be performed even more precisely as a result.

With the inventive method an air volume delivery rate is preferably determined with the aid of the result of the odor pollution determination.

By determining the air volume delivery rate it is possible to determine how great a volume of air has to be taken in by the vapor extraction device in order to minimize the odor pollution due to the cooking process optimally. This has the advantage that the fan speed can be set as a direct function of the odor pollution.

In particular the calculation of the air volume delivery rate is performed in such a manner that a curve of the delivery rate as a function of the current, relative odor level varies in steepness for different settable sensitivities. The calculated delivery rate can then optionally be supplied for further filtering, in particular low-pass filtering, to prevent fast adjustment of the fan speed to the odor pollution and therefore abrupt switching of the fan motor.

According to one preferred embodiment the controlling method includes at least the following steps:

determining a first odor status, determining a first odor level from the first odor status using a high-pass filter, performing a cooking process detection using the first odor level, determining a second odor level from the first odor status using a first low-pass filter and/or determining a third odor level from the first odor status using a low-pass filter;

determining a current, relative odor pollution as a function of the detection of a cooking process and time; and calculating an air volume delivery rate for the fan motor taking into account the current, relative odor pollution (M).

By high-pass filtering the first odor status it is possible to detect fast changes in the odor status that indicate a cooking process. These fast odor status changes represent the first odor level. In contrast slow changes in the odor status can be detected by low-pass filtering the first odor status. These indicate the climate of the cooking environment. These slow and constant odor status changes represent the second and third odor levels.

The two low-passes can detect both short-term and longer-term odor status changes for example by the suitable selection of different time constants. This allows conclusions to be drawn about both the basic climate of the cooking environment and the changing climate of the cooking environment, for example due to ventilation of the cooking environment by opening a window for a short time.

The combination of a cooking process detection, in which fast changes as occur during cooking are taken into account using a high-pass filter, and two low-passes, which detect slow constant changes in air quality, is advantageous as it allows all ambient conditions to be taken into account.

As variable reference values are also preferably used according to the invention, the reference values, which can function for example as threshold values, can be based on the odor status of the respective cooking environment and are therefore not permanently preset for a defined standard cooking environment.

According to the invention it is also possible for the result of the odor pollution determination also to be filtered to control the fan level of the fan motor of the fan of the vapor extraction device, such filtering preferably being low-pass filtering. Because the determined air volume delivery rate is supplied for example to a low-pass filter, the advantage is achieved that too fast an adjustment of the fan speed to the odor pollution is prevented.

In one advantageous embodiment of the invention provision is made for the method also to include:

determining a second odor status of a cooking environment of the vapor extraction device, performing an air cleaning effect determination over time, using a suitable combination of the two determined odor statuses, in particular using suitable differentiation of the two odor statuses, performing the air volume delivery rate determination with the additional aid of the result of the air cleaning effect determination.

In this advantageous embodiment of the invention the method for drawing a conclusion relating to the air cleaning effect of a vapor extraction device is integrated in the method for controlling a fan motor of a fan of a vapor extraction device.

This has the advantage that the result of the air volume delivery rate determination can be modified as a function of the air cleaning effect determination. For example an odor filter incorporated in the vapor extraction device, which has already absorbed a large number of odor particles, can significantly reduce the effectiveness of the air cleaning effect. This can be taken into account by applying the determined air volume delivery rate for example so that the fan speed has to be increased to achieve an identical or similar air cleaning effect to that which would be achieved using a fresh odor filter, when setting the fan speed according to the originally determined air volume delivery rate.

The invention has the advantage that the fan level of the fan of the vapor extraction device can always be set as a function of the odor pollution and the generated air flow of the vapor extraction device is therefore not too powerful or too weak to extract the cooking emissions such as odors and vapor. This allows both optimized power consumption and optimized noise pollution due to the vapor extraction device.

Figure 2:
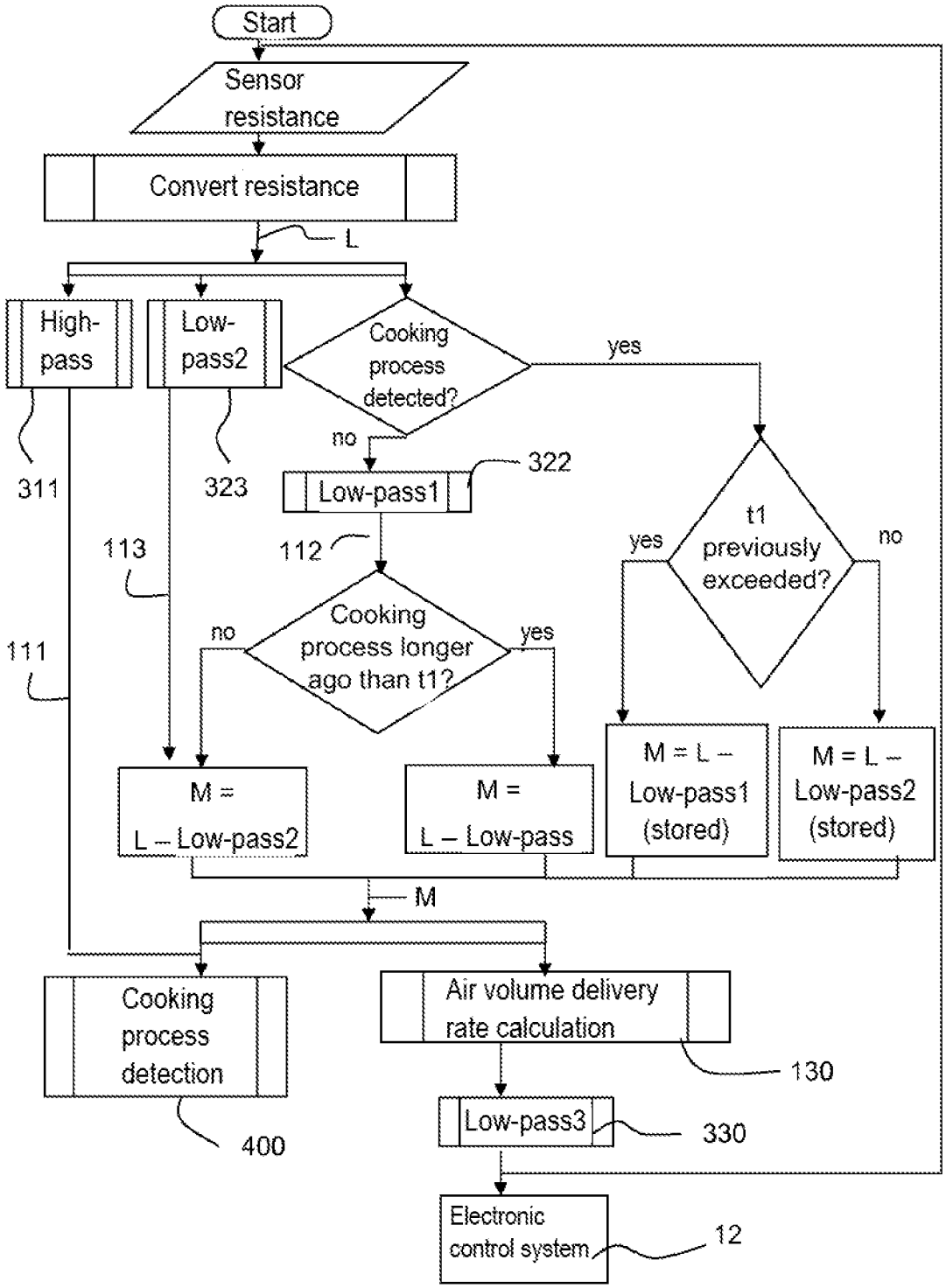
Figure 3:
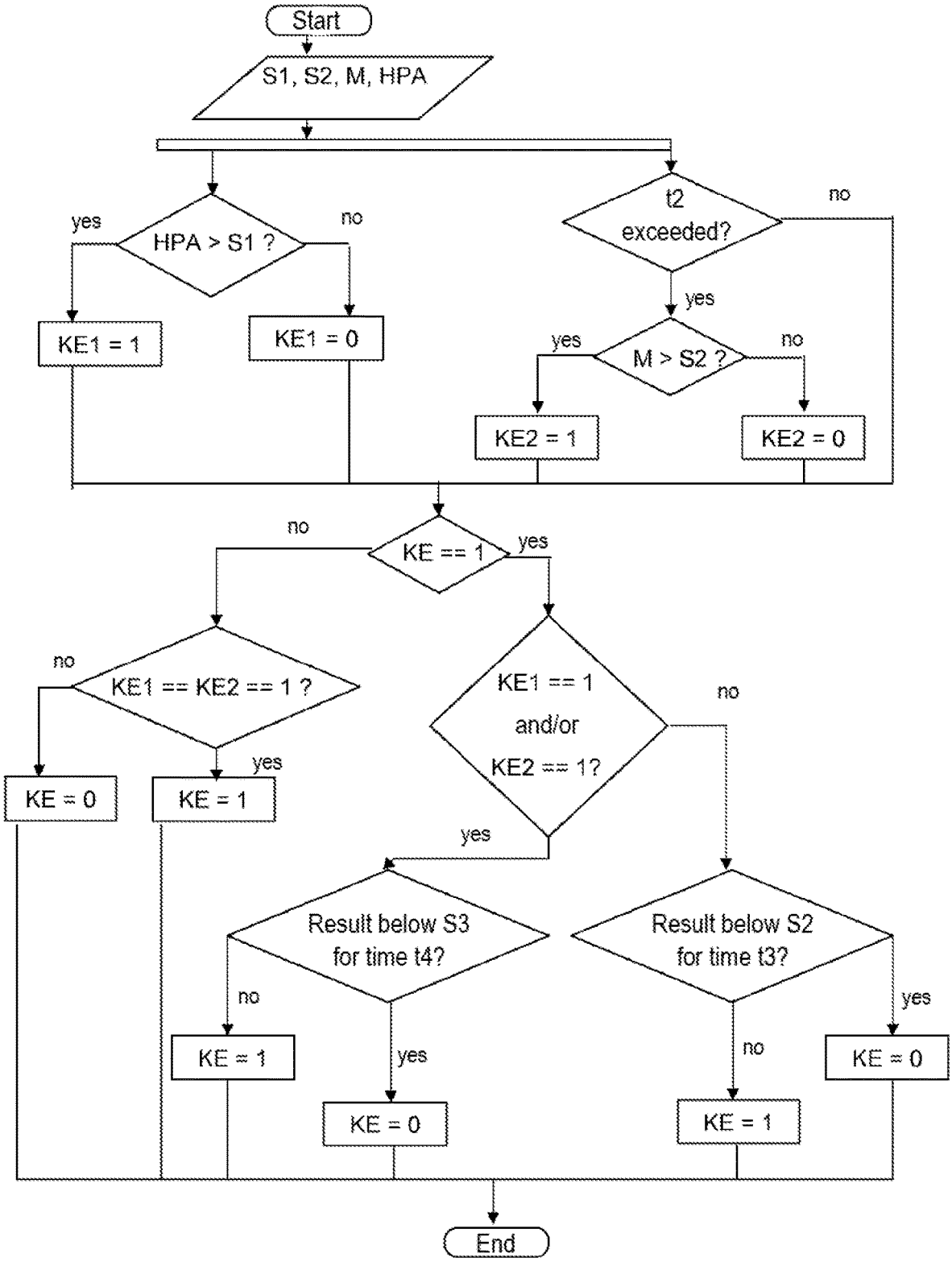
Figure 4:
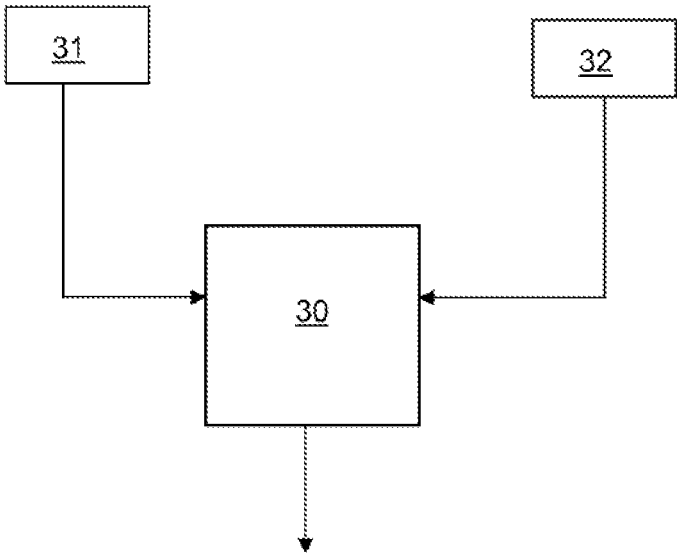
Figure 5:
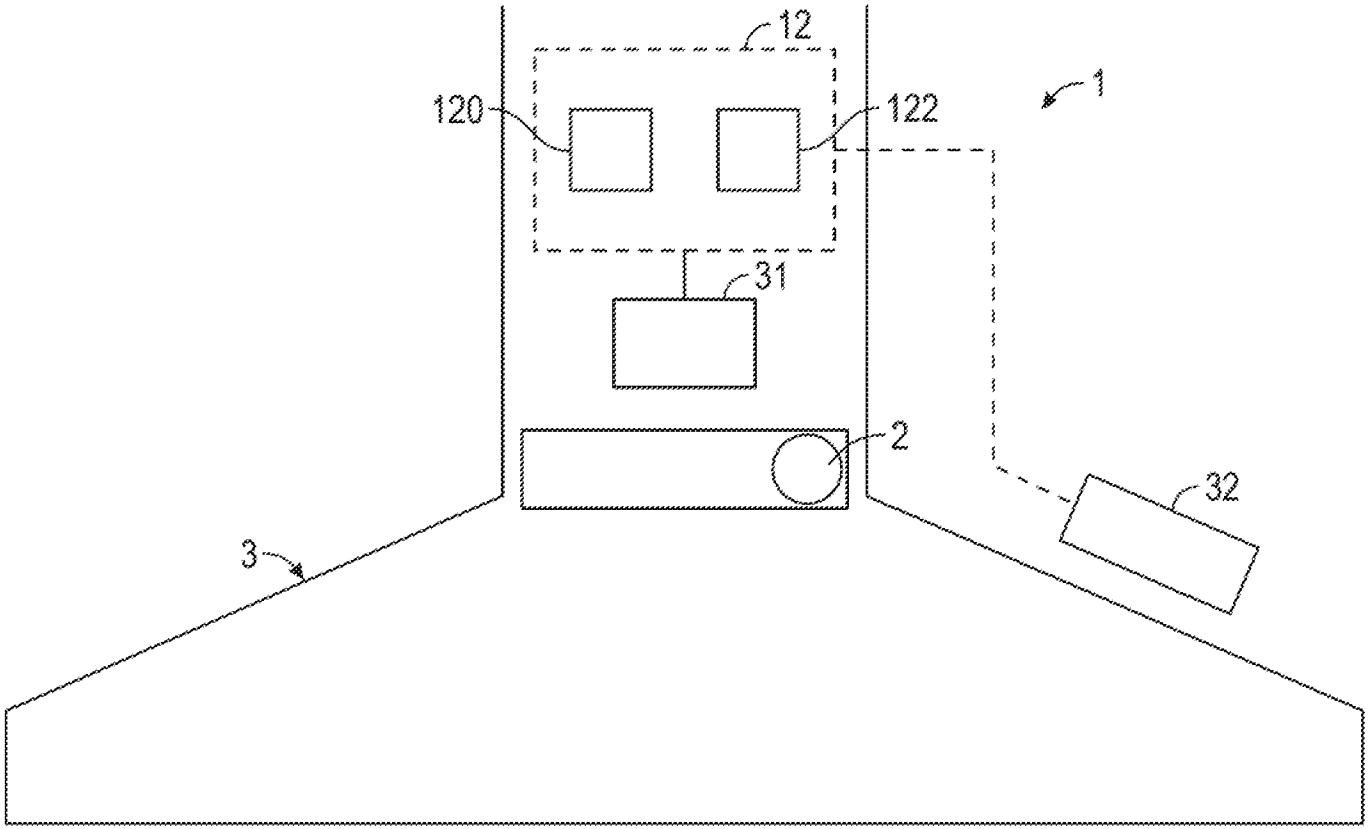

The invention is described in more detail below with reference to the figures, in which FIG. 1 shows a schematic diagram of parts of a vapor extraction device, in particular the electrical and electronic components, according to one embodiment of the invention, FIG. 2 shows a schematic diagram of a method for the regulated control of a fan motor of a fan of a vapor extraction device, according to one embodiment of the invention, FIG. 3 shows a schematic diagram of a cooking process detection from the method in FIG. 2, according to one embodiment of the invention, FIG. 4 shows a schematic diagram of the use of two sensors to determine the air cleaning effect, and FIG. 5 shows a schematic diagram of a vapor extraction device, according to one embodiment of the invention.

DETAILED DESCRIPTION OF EXEMPLARY EMBODIMENTS OF THE PRESENT INVENTION

Before embodiments of the invention are described in more detail below, it first should be noted that the invention is not limited to the described components of the device. Also the terminology used does not represent any restriction but is purely exemplary by nature. Where the singular is used in the description and claims below, the plural is also covered unless the context specifically excludes this.

FIGS. 1 and 5 show schematic diagrams of parts of a vapor extraction device, also referred to as a vapor extractor, in particular the electrical and electronic components, according to one embodiment of the invention.

By way of example the parts of the vapor extraction device 1 illustrated schematically in FIGS. 1 and 5 consist of a fan box 3, a sensor system 10 and the electronic system 11 for controlling the vapor extraction device 1. In the exemplary embodiment in FIG. 1 the electronic system 11 for controlling the vapor extraction device 1 consists of the modules of the electronic power and control system 12, the fan motor 2, the operating elements 13 of the vapor extraction device 1, the light 14 and the two further optional electrical elements 15, which can additionally be assigned. In the example in FIG. 1 the electronic power and control module 12 controls all the other modules 2, 13, 14, 15 of the electronic system of the vapor extraction device 1, for example the fan motor 2. The vapor extraction device 1 includes at least one cooking process detection unit 120 and at least one odor pollution determination unit 122. The at least one cooking process detection unit 120 and the at least one odor pollution determination unit 122 can be provided in a control device 12. The sensor system 10 consists of a first sensor 31, which is preferably a gas sensor, with independent microcontroller (μC) 5, in the following also referred to as control device. The sensor system 10 is positioned on an electronic circuit board together with the associated periphery, in other words for example passive and active components and plug-in connections. The sensor system 10 is integrated in the housing (not shown) enclosing the fan motor 2 or by means of an additional attachment tailored structurally to the respective fan incorporated in the vapor extraction device 1. The arrangement or integration of the sensor system is preferably achieved in such a manner that the sensor 31 is positioned in the air flow leaving the fan regardless of the number of intake openings. This ensures that the sensor 31 detects the odor being taken in regardless of where the odor and/or vapor is emitted outside the vapor extraction device 1.

The purpose of the sensor system 10 is in particular to measure the resistance of the gas sensor 31 and to use its value, which is a function of the gas concentration, to calculate the air volume delivery rate of a fan motor 2, as used in vapor extraction devices 1, and forward it to the electronic control system 12 of the vapor extraction device 1. This is to allow odors to be detected and the air volume delivery rate to be set infinitely as a function of the intensity of the odors.

FIG. 2 shows a schematic diagram of a method for the regulated control of a fan level of a fan of a vapor extraction device, according to one embodiment of the invention.

In a first step the captured sensor information is used to determine a first odor status L. In a second step the first odor status L is supplied to a high-pass filter 311 and a first and second low-pass filter 322, 323. Three odor levels 111, 112, 113 are determined by means of these filtering operations. The first low-pass filtering 322 of the first odor status L is however only performed at times when no cooking process is detected. Detection of the cooking process is described in more detail below with reference to FIG. 3. The first odor level 111, in other words the output of the high-pass 311, is used to detect a cooking process 400 in a third step. In a fourth step a value M is determined, which indicates the current relative odor pollution or can be used to determine this. M therefore represents the result of the odor pollution determination. Depending on whether or not a cooking process is detected, the current value of the output of the first or second low-pass 322, 323 or a previous value of the output of the first or second low-pass 322, 323 is used as a function of an elapsed time interval $t_1$ to determine the value M of the current relative odor pollution. The outputs of the first and second low-pass 322, 323 represent the second and third odor level 112, 113 within the meaning of the invention. The value M of the current relative odor pollution is then used to determine the air volume delivery rate, which is then supplied to an electronic control system 12 for fan control.

By way of example the method illustrated schematically in FIG. 2 consists in more detail of the following steps: at the start of the method the sensor resistance is read by the control device 5 and converted to a dimensionless variable using a formula. This variable is then low-pass filtered for smoothing. In the example in FIG. 2 this smoothed result corresponds to the first odor status L within the meaning of the invention. Depending on a state of the system the odor status L is supplied to a first low-pass filter 322 and/or a second low-pass filter 323 and in any case to a high-pass filter 311. The first low-pass filter 322 is used to calculate a sliding mean value of the air quality over a specific time $t_{r1}$. In the example in FIG. 2 this corresponds to the second odor level 112 within the meaning of the invention. The second low-pass filter 323 is used to calculate a sliding mean value of the air quality over a specific time $t_{r2}$, which is shorter than $t_{r1}$. In the example in FIG. 2 this corresponds to the third odor level 113 within the meaning of the invention.

Depending on the state of the system a value M is formed, which represents the current relative odor pollution or from which this can be calculated. The value M of the current relative odor pollution is formed as follows: if the system has detected a cooking process, depending on whether a defined time $t_1$ has been exceeded, the calculation of the first low-pass filter 322 is stopped, its last value being buffered and subtracted from the first odor status L. However if the time $t_1$ has not yet been exceeded, this value of the second low-pass filter 323 is buffered and subtracted from the first odor status L. In contrast to the first low-pass filter 322 the calculation of the second low-pass filter 323 is not stopped during a cooking process. However only the last value, which was available immediately before detection of the cooking process 400, is used to calculate the value M for calculating the current relative odor pollution. Should the formed value M of the current relative odor pollution be negative, it is set to zero.

If no cooking process is detected and the last cooking process took place longer ago than the defined time $t_1$, the value of the first low-pass 322 is subtracted from the first odor status L. If the system has not detected a cooking process and the last cooking process did not take place longer ago than the time $t_1$, the value of the second low-pass 323 is subtracted from the first odor status L. If no cooking process is detected, the calculation of the first low-pass filter 322 continues. The function of the second low-pass filter 323 continues independently of a detected cooking process.

The combination of the cooking process detection 400 and the two low-passes 322, 323 allows a distinction to be made between slow, constant changes in air quality and fast changes of the odor level 111, as occur during cooking processes. The slow, constant changes in air quality correspond to the second and third odor level 112, 113 within the meaning of the invention, while the fast changes in air quality correspond to the first odor level 111 within the meaning of the invention. Therefore a difference between the odor status of the ambient air of the room and the fast-changing odor level during a cooking process is always used when calculating the air volume delivery rate. The odor level of the ambient air in the room therefore corresponds to the second and third odor level 112, 113 within the meaning of the invention. Therefore when there are different odor statuses at the start of a cooking process it is possible to detect the cooking process and mask out the odor status of the room.

The air volume delivery rate is calculated in such a manner that the curve of the delivery rate as a function of M, in other words the relative odor pollution, varies in steepness for different settable sensitivities. In the illustrated embodiment the calculated delivery rate is supplied to a third low-pass filter 330 to prevent too fast an adjustment of the fan speed to the odor pollution.

The algorithm is therefore characterized as follows:

The odor level of the ambient air 112, 113 is determined on a permanent basis using the first and second low-pass 322, 323 and in active automatic mode a cooking process detection 400 is performed with the aid of the high-pass 311 and threshold values, which are a function of the odor status L, which can also be referred to as an absolute odor level. The threshold values, which are a function of the odor status, correspond here to the first and second reference value within the meaning of the invention. By forming a relative odor level and using a constant function to calculate the air volume delivery rate it is possible to control the fan speed, also referred to as the fan level, in an infinite and automatic manner, thereby achieving infinite air delivery rates.

The combination of the evaluation algorithm with the selected position of the gas sensor 31 provides a solution which allows automatic infinite control of the fan speed, in other words of the fan level and the resulting air volume delivery rate, regardless of where odors and/or vapor is/are emitted below the vapor extraction device 1 and how high or low the current absolute odor level, in other words the odor status L, of the room is.

One advantage of the invention compared with known solutions is that the invention provides a solution that is not visible to the user outside. A further advantage of the invention compared with known solutions is that the air volume delivery rate can be set infinitely, as a function of the digital resolution, if the further electrical and electronic components 13, 14, 15 of the appliance allow it, for example when using an infinitely controllable motor as the fan motor 2.

FIG. 3 shows a schematic diagram of a cooking process detection 400 from the method in FIG. 2, according to one embodiment of the invention.

In FIG. 3 parameters are first read in after the start of the cooking process detection. These are in particular the parameters S1, S2, M and the first odor level 111, which is also referred to as the output of the high-pass filter (HPA).

In a first comparison step the first odor level 111 is compared with a first reference value S1, which represents a threshold value. In a second comparison step a previously determined value M of the current relative odor pollution is compared with a second reference value S2, which represents a threshold value. Before this further comparison a defined exceeding of a time t2 is monitored.

In a following step the detection control is performed based on the results of the two comparison steps. In the further steps it is therefore determined whether the detected cooking process is still deemed to be detected or is deemed not to be detected. The cooking process determination 400 method is then terminated.

A high-pass filter 311 corresponding to the one in FIG. 2 serves to detect a cooking process. The cooking process detection 400 is achieved by way of the comparison of the high-pass filter output HPA, which represents the first odor level 111, with a first reference value S1. This first reference value S1, which also represents a first threshold value S1, is a function of the first odor status L, which is determined as shown in FIG. 2. If the currently valid first threshold value S1 is exceeded, a cooking process is deemed to be detected. The value of the current relative odor pollution M is also compared in a defined time interval $t_2$ with another second reference value S2 which is a function of the first odor status L and also represents a second threshold value S2. If M exceeds the currently valid second threshold value S2, a cooking process is also deemed to be detected. The check to determine whether a cooking process has been detected is indicated in FIG. 3 by KE==1. In the event of a change from the state in which a cooking process is deemed not to have been detected to the state in which a cooking process is deemed to have been detected both of the abovementioned conditions have to be satisfied. In other words both the first odor level 111, which represents the output of the high-pass filter 311 and can therefore also be referred to as HPA, must exceed the first reference value S1 (HPA>S1) and the value for calculating the current relative odor pollution M must exceed the second reference value (M>S2) after a defined time interval $t_2$ has elapsed. In order to keep the system in the state in which a cooking process is deemed to have been detected, only one of the two abovementioned conditions has to be satisfied. In order to prevent a premature reduction of the air volume delivery rate due to a brief drop below the second reference value S2 for a cooking process detection, a defined time $t_3$ must have elapsed before the system switches to the state in which a cooking process is deemed not to have been detected. There is also a third reference value S3, which also represents a threshold value S3, which prevents the system incorrectly remaining in the state in which a cooking process is deemed to have been detected in certain circumstances. To this end the output of the high-pass 311, in other words the first odor level 111, is compared with this third threshold value S3. If the result is below this third threshold value S3 for a defined time $t_4$, the system is switched to the state in which a cooking process is deemed not to have been detected—even if the value for calculating the current relative odor pollution M should exceed its associated second threshold value S2.

The evaluation algorithm according to the invention allows cooking processes to be detected in different ambient air conditions. The fan level is not calculated by way of the absolute odor level, in other words the odor status L, but by way of a relative change in the odor status of the ambient air in the room. A distinction is made as to whether the relative change compared with the previous odor status is caused for example by fresh air supplied through an open window, extended opening of a waste bin, the presence of a number of people in the room and so on, or otherwise by a cooking process.

The cooking process detection 400 in conjunction with the masking out of slow and constant changes in the odor status is therefore the central property of the evaluation algorithm in contrast to hitherto known technical solutions. The algorithm described above avoids too high or low an air delivery power due to different odor statuses of the ambient air and sudden changes in fan speed.

The sensor principle allows reliable odor and therefore vapor detection even at high air delivery rates and with the associated flow speeds and turbulences. The low power consumption of the sensor system also allows permanent operation even when the vapor extractor is in standby mode or soft-off mode, allowing it to monitor the odor status of the room in which it is used and thereby ensuring that automatic operation is available immediately after the appliance is switched on without adversely affecting operation.

In conjunction with an infinitely controllable fan motor 2 the sensor system allows energy-efficient and noise-efficient odor extraction.

A further possible application of the sensor system 10 is shown in FIG. 4. Two sensors 31, 32 are used here. The first sensor 31 can be positioned 31 in the position described above and outputs sensor information, as described above, from which a first odor status L can be determined. The second sensor 32 is positioned for example outside the vapor extraction device 1 and in proximity thereto. The second sensor 32 outputs sensor information, from which a second odor status 102 can be determined. If an active carbon filter is integrated in the vapor extraction device 1 and the vapor extraction device 1 is operated as a circulating air appliance, a conclusion relating to the air cleaning effect of the active carbon over time can be concluded by way of the processing unit 30 based on the differential signal from the two sensors 31, 32. This application also allows a conclusion to be drawn relating to the degree of saturation of the active carbon.

The invention claimed is:

1. A method for performing an air cleaning effect determination of a vapor extraction device, said method comprising the steps of:

providing a fan with a fan motor, a first sensor, a second sensor, and a control device coupled with the first sensor, the second sensor, and the fan motor, determining, from the first sensor, a first odor status of a cooking environment of the vapor extraction device, wherein the first odor status is related to a current active cooking process, determining, from the second sensor, a second odor status of the cooking environment of the vapor extraction device, wherein the second odor status is related to a cooking climate over a period of time, wherein the second odor status is determined only when no active cooking processes are detected, performing, at the control device, an air cleaning effect determination as a function of time of the cooking environment by combining the two determined odor statuses to compare the current active cooking process and the cooking climate, and adjusting, by the control device, the fan motor based on the air cleaning effect determination.

2. The method of claim 1, wherein the performing step includes a differentiation between the first and second odor statuses.

3. The method of claim 1, further comprising the step of determining an air volume delivery rate in response to the air cleaning effect determination.

4. A method for controlling a fan motor of a fan of a vapor extraction device, said method comprising the steps of:

determining a first odor status of a cooking environment of the vapor extraction device with a first sensor, performing, at a control device, a cooking process detection based on the first sensor to detect a current active cooking process, performing, at the control device, an odor pollution determination related to a cooking climate over a period of time, wherein the odor pollution determination is determined only when no active cooking processes are detected, the odor pollution determination being performed as a function of time of the cooking environment, comparing the cooking process detection and the odor pollution determination, and controlling the fan motor of the vapor extraction device to a fan level in response to the odor pollution determination.

5. The method of claim 4, further comprising the steps of:

determining a first odor level from the first odor status, determining and/or supplying a first reference value, which represents a threshold value, and performing the cooking process detection in response to the first odor level and the first reference value.

6. The method of claim 5, wherein the first reference value is a function of the first odor status of the cooking environment and/or of a time constant.

7. The method of claim 5, further comprising the step of determining and/or supplying a second reference value, which represents a threshold value, said cooking process detection being performed in response to the first and second reference values.

8. The method of claim 7, wherein the first and second reference values are a function of the first odor status of the cooking environment and/or of a time constant.

9. The method of claim 4, wherein a result of the odor pollution determination is used during at least one subsequent cooking process detection.

10. The method of claim 5, further comprising the steps of:

determining at least a second odor level from the first odor status, and determining a current relative odor pollution of the cooking environment as a function of the second odor level.

11. The method of claim 10, further comprising the step of separately determining the first and second odor levels from the first odor status by detecting fast changes and slow changes in the odor status.

12. The method of claim 11, wherein fast and slow changes in the odor status are detected by filters.

13. The method of claim 12, wherein the filters include at least one high-pass filter or at least one low-pass filter.

14. The method of claim 5, wherein different odor levels are determined as a function of time upon odor level determination.

15. The method of claim 4, wherein the cooking process detection comprises a detection control configured to check a result of the cooking process detection.

16. The method of claim 4, further comprising the steps of:

determining a first odor level from the first odor status using a high-pass filter, performing a cooking process detection using the first odor level, determining at least a second odor level from the first odor status using a first low-pass filter;

determining a current, relative odor pollution as a function of a detection of a cooking process and time; and calculating an air volume delivery rate for the fan motor as a function of the current, relative odor pollution.

17. The method of claim 5, further comprising the steps of:

determining a second odor status of the cooking environment of the vapor extraction device, performing an air cleaning effect determination by combining the first and second odor statuses, and determining an air volume delivery rate in response to the air cleaning effect determination.

18. The method of claim 17, wherein the performing the air cleaning effect determination includes a differentiation between the first and second odor statuses.

* * * * *